US005390610A

United States Patent [19]

Gutgsell

[11] Patent Number: 5,390,610

[45] Date of Patent: Feb. 21, 1995

[54] CARRYING HANDLES FOR A FOLDING TABLE LEG APPARATUS

[75] Inventor: David R. Gutgsell, Jasper, Ind.

[73] Assignee: Ditto Sales, Jasper, Ind.

[21] Appl. No.: 942,980

[22] Filed: Sep. 10, 1992

[51] Int. Cl.[6] ..... A47B 3/00

[52] U.S. Cl. ..... 108/132; 108/150; 248/188.6; 248/439

[58] Field of Search ..... 108/115, 121, 127, 131, 108/132, 133, 150, 64; 38/DIG. 1, DIG. 2, DIG. 3, 137; 16/225; 292/DIG. 38; 248/188.6, 439; 312/351.2

[56] References Cited

U.S. PATENT DOCUMENTS

| | | | |
|---|---|---|---|
| 134,149 | 12/1872 | King | 108/132 X |
| 1,782,623 | 11/1930 | McCaslin | 108/131 |
| 2,131,594 | 9/1938 | Miller | 108/131 |
| 3,319,958 | 5/1967 | Bender | 108/131 X |
| 3,742,869 | 7/1973 | Polsky et al. | 108/64 |
| 3,885,829 | 5/1975 | Haeger | 248/188.6 X |
| 4,838,179 | 6/1989 | Bing | 108/132 |
| 4,838,180 | 6/1989 | Gutgsell | 108/132 |

*Primary Examiner*—Clifford D. Crowder
*Assistant Examiner*—Ismael Izaguirre
*Attorney, Agent, or Firm*—Woodard, Emhardt, Naughton, Moriarty & McNett

[57] ABSTRACT

A folding table includes a tabletop and a number of legs operable between a folded and an extended position. A folding table leg apparatus associated with each of the legs comprises a plate assembly mounted to the tabletop, the plate assembly having a pair of handles. Each of the handles has a height greater than the effective diameter of one leg. The handles and the plate assembly define an envelope within which the leg is contained in its folded position and the folding apparatus itself is fully contained within the envelope when the leg is in its folded position. The handles are provided near the center of gravity of the tabletop to improve its maneuverability during handling and facilitate operation of the folding mechanism.

17 Claims, 2 Drawing Sheets

CARRYING HANDLES FOR A FOLDING TABLE LEG APPARATUS

BACKGROUND OF THE INVENTION

This invention pertains generally to folding furniture, and more specifically to tables having legs that fold compactly underneath the tabletop.

Folding tables are widely used and derive their primary benefit from the relative ease with which they can be handled and stored when in the folded condition. U.S. Pat. No. 4,838,180, issued to a common assignee on Jun. 13, 1989, discloses a mechanically simple, yet efficient, folding table leg apparatus which both permits the table leg to be compactly folded underneath the tabletop and provides a uniform surface on which other tables may be stacked, thus facilitating easy storage of the folding table.

Still, there is always a need for further improvements in the design and construction of folding tables and, in particular, a folding table which is easily folded and then conveniently carried in its stored or folded position. Typically, for ease of transport, folding tables are carried on their side when in the folded position by either grasping the tabletop or the table leg. When carrying a folding table on its side by gripping the tabletop, it is difficult to maintain a grip since the tabletop has no convenient hand hold area. Some tables include a peripheral frame bolted to the edges of the tabletop, wherein the frame is aesthetically pleasing and/or useful for stacking tables. However, the frame does not provide adequate support as a land hold for grasping and carrying the table on its side, instead tending to bend and separate from the tabletop. Further, by grasping the frame remote from the center of gravity of the tabletop, a pendulum effect results when carrying the table thereby making the table difficult to maneuver.

As an alternative to grasping the tabletop and to improve maneuverability during handling, the folding table is often grasped by the table leg near the center of gravity of the tabletop. However, carrying a folding table on its side by grasping the table leg is equally undesirable. The table leg is designed to vertically support the table when in its extended position, rather than to provide a hand hold for carrying the folding table on its side when in its folded position. In some instances, when carrying a folding table in this fashion, the various linkages of the folding mechanism will actually loosen and/or bend under the weight of the table, or the mechanism will spontaneously open.

Therefore, with these disadvantages in mind, a need exists for an improved folding table which is easily carried on its side. Ideally, the folding table should be easily maneuvered when carried and include sturdy hand holds near its center of gravity. Further, hand holds and the like provided for a folding table should be compatible with existing folding table leg apparatus such as that disclosed in U.S. Pat. No. 4,838,180.

SUMMARY OF THE INVENTION

A folding table leg apparatus for a folding table having a tabletop and at least one leg operable between a folded and an extended position, according to one embodiment of the present invention includes a plate assembly and means for mounting the plate assembly to the tabletop. A pair of handles project from the plate assembly and define an envelope adjacent to the plate assembly. Each of the handles has a height greater than the effective diameter of the leg and defines an elongated opening between the handle and the tabletop to facilitate grasping of the handle. Means, attachable to the leg, are provided for folding the leg from the extended position in which the leg supports the tabletop to the folded position in which the leg is folded within the envelope, with the folding means likewise fully contained within the envelope.

One object of the present invention is to provide an improved folding table which is easily carried. Another object of the present invention is to provide a folding table having hand holds near its center of gravity to improve its maneuverability during handling.

Still another object of the present invention is to provide a folding table having hand holds which are compatible with existing folding table leg apparatus. Yet another object of the present invention is to provide a folding table having hand holds which facilitate operation of the folding mechanism.

These and other related objects and advantages will become apparent from the following drawings and written description.

DESCRIPTION OF THE PREFERRED EMBODIMENT

Figure 1:
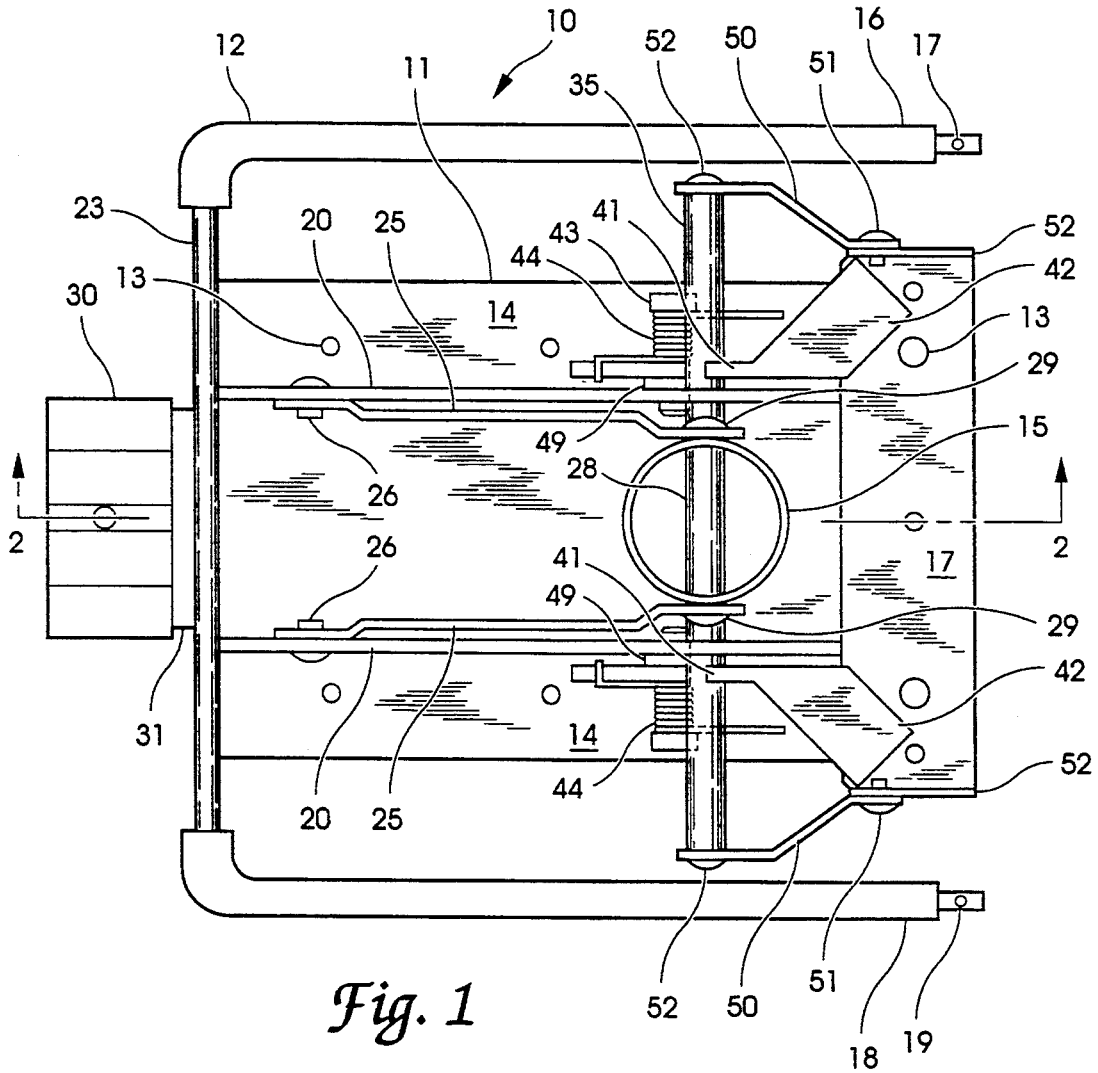
FIG. 1 is a bottom elevational view of a folding table leg apparatus with the table leg in its extended position according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
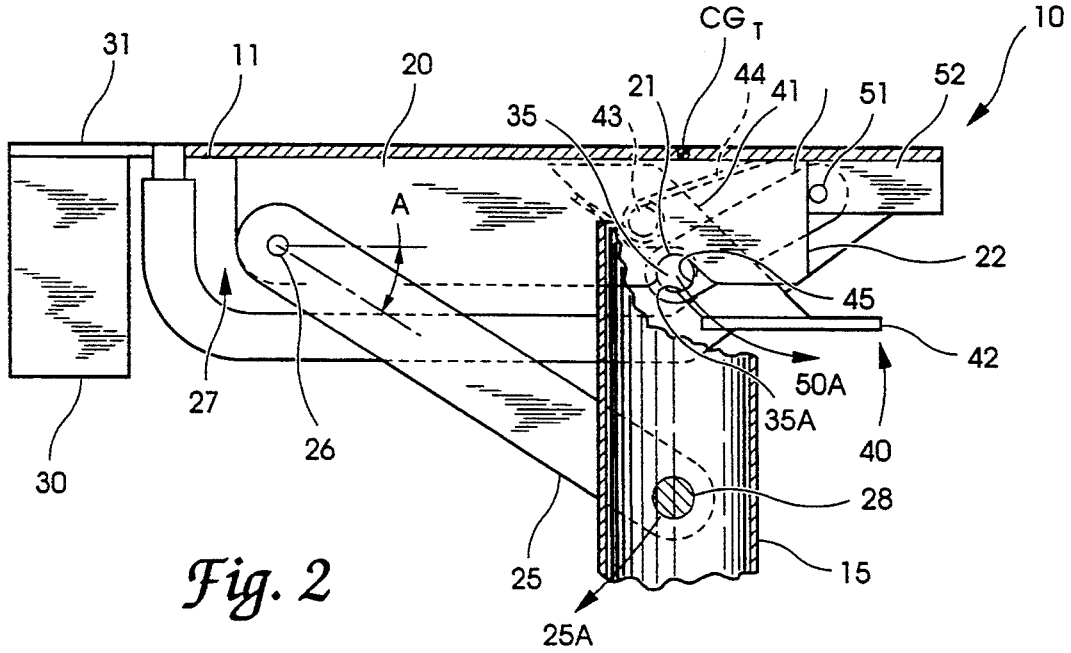
FIG. 2 is a cross-sectional view of the folding table leg apparatus shown in FIG. 1 taken along the line 2—2 as viewed in the direction of the arrows.

Referring now to FIGS. 1 and 2, a folding table leg apparatus 10 according to one embodiment of the present invention is shown in its extended position. Folding table leg apparatus 10 includes a plate assembly 11 having a handle assembly 12 attached thereto. The assembly 12 includes handles 16 and 18 which provide hand holds to facilitate operation of the folding mechanism and to provide a means for grasping and carrying a folding table when in its stored or folded position. Handle assembly 12 includes a cross bar 23 attached between handles 16 and 18. Assembly 12 is preferably attached to plate assembly 11 at cross bar 23 by means of welding, wherein handles 16 and 18 extend cantilevered from cross bar 23 and the welded attachment.

The folding table leg apparatus 10 includes a plurality of mounting holes 13 through the plate assembly 11 so that the plate assembly can be affixed to the underneath side of a tabletop by suitable means such as fasteners. Handles 16 and 18 also include mounting holes 17 and 19 as means for mounting the distal ends of the respective handles to the underneath side of a tabletop. When mounted to a tabletop the handles 16 and 18 define elongated openings 24 and 27, respectively, between each handle and the tabletop to facilitate grasping of each handle.

The folding table leg apparatus 10 includes a vertical leg 15 that extends downward perpendicular to the plate assembly 11 when the leg is in its extended configuration as shown in FIGS. 1 and 2. In the preferred embodiment, the vertical leg 15 is a hollow cylindrical post. However, the present invention is not limited to legs of this type, so that solid or hollow legs of various cross sections may be used with the folding table leg apparatus 10.

Top member 11 is constructed by welding a pair of right angle brackets 14 to a cross plate 17. As such, plate assembly 11 of apparatus 10 is generally of lighter construction and has a smaller footprint than the corresponding top plate 11 described in U.S. Pat. No. 4,838,180. By further reducing the size and weight of apparatus 10, handling and maneuverability of a tabletop mounted thereon are enhanced. Brackets 14 define a pair of support flanges 20 oriented perpendicular to the underside of plate assembly 11. The support flanges 20 are laterally spaced apart and define an opening through plate assembly 11 sufficient to accommodate the various folding components associated with vertical leg 15. These folding components are substantially as shown and described in the aforementioned U.S. Pat. No. 4,838,180, which description is incorporated herein by reference. The apparatus described in the '180 patent is modified somewhat to accommodate the handle assembly 12 of the present invention and to enhance the ease of using the folding mechanism. With this background, certain details of the folding mechanism will be described for clarity.

The vertical leg 15 is connected to the support brackets 20 by a pair of brace links 25. The brace links 25 are pivotably mounted to the respective support brackets 20 by pivot rivet 26. The brace links 25 are attached at their distal ends to the vertical leg 15 by a lower pivot rod 28 that pivots within a bore extending diametrically through the vertical leg 15. The brace links 25 are affixed to the lower pivot rod 28 by a pair of cap screws 29.

The lower pivot rod 28 is situated sufficiently far down from the top of the vertical leg 15 so that the brace links 25 are oriented at a support angle A relative to the plate assembly 11, as shown in FIG. 2, when the vertical leg is in its extended position. The brace links 25 thus provide adequate fore-aft support for the vertical leg in its extended position to prevent the leg from buckling. The use of the pair of brace links 25 also insures that the bracing support for the vertical leg 15 will be uniform on either side of the leg. In addition, because the brace links 25 are essentially straddling the vertical leg 15, the leg can be rotated between the two brace links 25 when the folding table leg apparatus is moved to its folded position for storage. This feature means that the apparatus 10 presents a thinner stored table than has been previously encountered with tables having but a single support strut.

In the extended position, the vertical leg 15 relies upon upper pivot rod 35 to provide the vertical restraint for the leg. Pivot rod 35 extends through a bore in the vertical leg 15 adjacent the top of the leg. The upper pivot rod 35 extends across and beyond the plate assembly 11 with its ends being directly adjacent handles 16 and 18 of handle assembly 12. When the vertical leg 15 is in its extended position, upper pivot rod 35 rests against a support surface in the support bracket 20, in the present embodiment formed by notch 21 (FIG. 2). Thus, a vertical force exerted on vertical leg 15 produces a component at the upper pivot rod 35 acting against notch 21, and a vector component acting on brace link 25 through pivot rivet 26 into the support bracket 20.

Fore and aft restraint for the upper pivot rod 35 is provided by release bracket 40. The release bracket 40 includes a lever arm 41 that is pivotably mounted at one end to the support bracket 20 by a pivot pin 43 extending through a shoulder bushing 49. At the other end of the lever arm 41 is an actuator plate 42 that can be pressed to disengage the release bracket and allow the upper pivot rod 35 to be freely rotated out of the notch 21. The release bracket 40 is biased into the locking position, as shown in FIG. 2, by a torsion spring 44 situated around pivot pin 43 and engaged between the lever arm 41 and the plate assembly 11. Thus, when the vertical leg 15 is in its extended position, as shown in FIGS. 1 and 2, the torsion spring 44 operates to positively lock the pair of release brackets 40 against the upper pivot rod 35. The upper pivot rod 35 reacts against a cam edge 45 on the lever arm 41 as described in further detail in U.S. Pat. No. 4,838,180.

One benefit of the folding table leg apparatus 10 of the present embodiment is the capability for compactly storing the vertical leg 15 in its retracted position. The brace link 25 that is pivotably mounted to the vertical leg 15 by lower pivot rod 28 is one aspect of the present invention used to accomplish this compact storage. The swivel bracket 50, shown in FIGS. 1 and 2, provides the other element of this compact storage capability. The swivel brackets 50 are pivotably mounted to side flanges 52 of plate assembly 11 by blind rivets 51. The swivel bracket 50 is engaged at its other end to the upper pivot rod 35 by way of a buttonhead cap screw 52. The swivel bracket 50 is not intended to act as a load carrying element; however, it is permissible within the scope of the present invention to use the swivel bracket 50 to provide some fore-aft and vertical restraint for the upper pivot rod 35.

Figure 3:
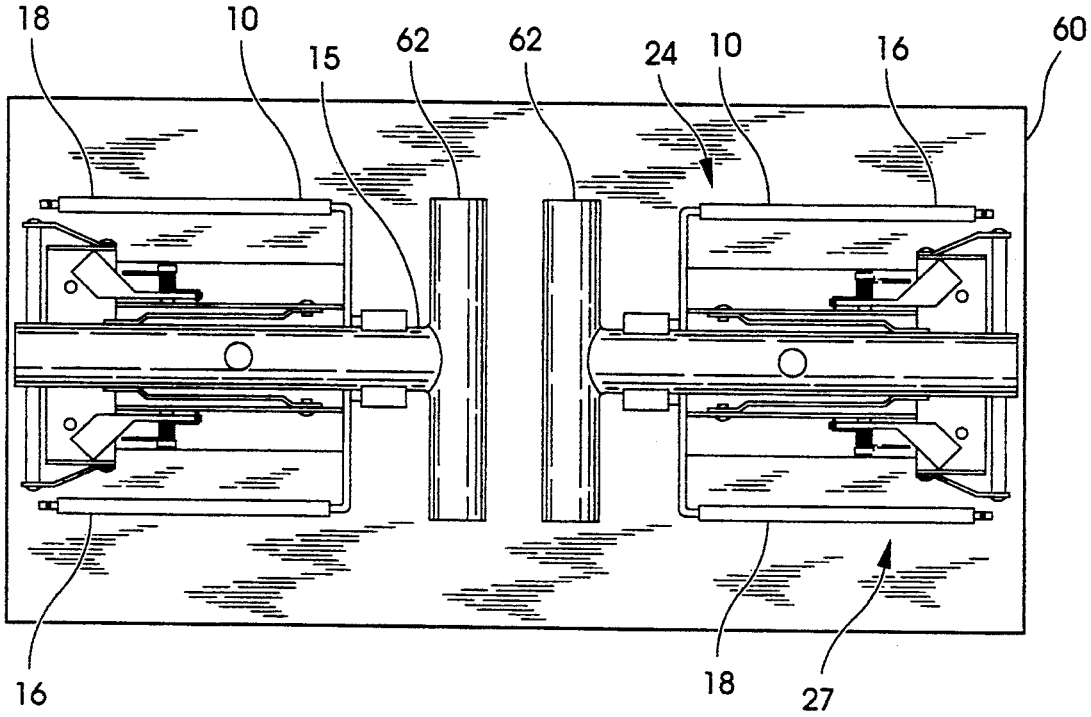
FIG. 3 is a bottom elevational view of a table with a pair of folding table leg apparatus of FIG. 1 mounted to the underneath side of the tabletop.
Figure 4:
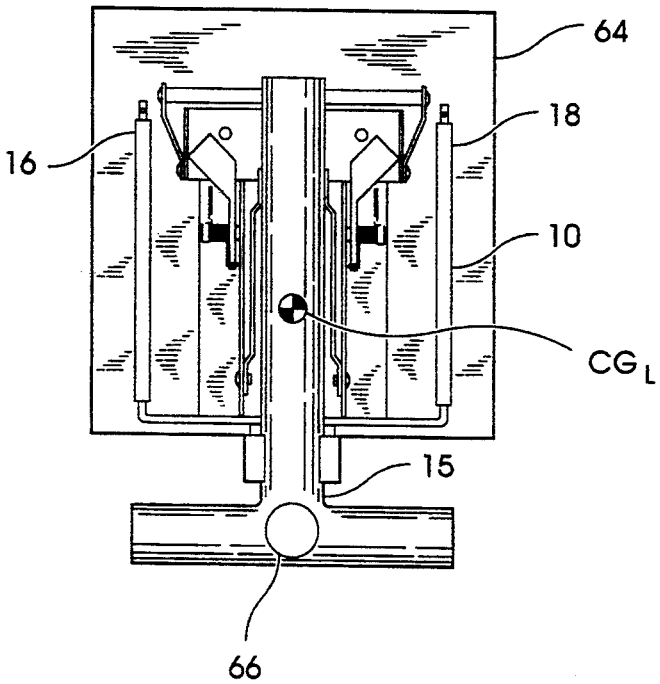
FIG. 4 is a side elevational view of a table with a folding pedestal table leg apparatus mounted to the underneath side of the tabletop.

When the vertical leg 15 is moved from its extended position, as shown in FIGS. 1 and 2, to its folded or stowed condition, as shown in FIGS. 3 or 4, the brace links 25 and swivel brackets 50 pivot about their pivot points on support brackets 20 and side flanges 52, respectively. The ends of the brace links 25 and swivel brackets 50 that are pivotably engaged with the vertical leg 15 rotate in the paths 25A and 50A, respectively (FIG. 2). The operation and movement of the folding mechanism is substantially as described in U.S. Pat. No. 4,838,180 incorporated by reference.

In the folded position, the outer diameter of the vertical leg 15 lies generally planar with handles 16 and 18 of handle assembly 12. Unlike many folding table leg constructions of the prior art, the folding mechanism of the present invention resides entirely within the lateral envelope defined by handles 16 and 18. Moreover, unlike other folding leg constructions, the folded table leg itself resides entirely between the tabletop and a plane formed by the outermost edges of handles 16 and 18. Rubber tubing 55 encircle handles 16 and 18, forming a separate stacking surface apart from the folded leg 15. The rubber tubing 55 is composed of a non-marring rubber material so that the tabletop of another folded table can be stacked on the rubber tubing 55 for storage.

In a further aspect of this embodiment, plate assembly 11 includes a resiliently flexible C-clamp 30 mounted thereto which releasably clamps table leg 15 in its folded or stowed position. Prior folding tables have employed separate clamping means affixed to the underneath side of a tabletop such as described in the '180 patent. By combining the clamping means with the folding table leg apparatus 10 a more compact folding table leg apparatus results. C-clamp 30 is attached to plate assembly 11 by means of an extension plate 31 which is welded to and extends aft of handle assembly 12. C-clamp 30 is constructed of a resiliently flexible plastic material and has an inner diameter which approximates the effective diameter of table leg 15. As such, during handling and transport of a table, table leg 15 is restrained in its folded position by C-clamp 30 against inadvertent and unwanted extension.

Handle assembly 12 can facilitate the depression of actuator plates 42 of release brackets 40 by providing a hand hold which may be gripped by a user's hands while the user's thumbs depress actuator plates 42. As such, the pushing force exerted on the actuator plates by the user is reacted by the pulling force exerted by the user against handles 16 and 18, rather than reacted by an external surface such as that provided by a wall or floor.

Referring now to FIG. 3, a conventional table configuration is illustrated in which a tabletop 60 has a pair of folding table leg apparatus 10 mounted thereon. Each of the legs affixed to tabletop 60 includes the vertical leg 15 affixed to a horizontal leg 62 in a standard fashion. When the table is folded and situated on its side, either handle 16 or 18 of each folding apparatus may be grasped to facilitate carrying of the table by two people. Because the handles are located near the center of gravity of the tabletop, the table is more easily maneuvered when carried on its side in its folded position.

Referring now to FIG. 4, the folding table leg apparatus of the present invention is shown used with a tilt table tabletop 64. In this design, a cross leg 66, or X-configured leg, is mounted to the vertical leg 15. The tabletop 64 is affixed to the folding table leg apparatus 10 so that the top can be tilted down while the cross leg 66 and the vertical leg 15 remain standing upright. In this configuration, the apparatus 10 is not being used to fold a table leg into the table body, but is being used to allow the tabletop itself to be tilted relative to the table leg. One advantage of this application of the apparatus 10 is that the center of gravity of the tilted tabletop is moved considerably lower than with prior art tilting mechanisms. The lowering of the tabletop's center of gravity thereby improves the stability of the table when the tabletop has been tilted. Additionally, by attaching handles 16 and 18 between the tilting mechanism and the table top, the handles may be located between the tabletop and pedestal leg centers of gravity $C.G._T$ in FIG. 2 and $C.G._L$ in FIG. 4, respectively, and therefore more near the combined center of gravity of the tabletop and pedestal leg, to facilitate handling and maneuverability when carrying the table in its folded position.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A folding table leg apparatus for a folding table having a tabletop and at least one leg operable between a folded and an extended position, said folding table leg apparatus comprising:

a plate assembly;

means for mounting said plate assembly to the tabletop;

a pair of handles projecting from said plate assembly and defining an envelope adjacent to said plate assembly, each of said handles having a height from the tabletop greater than the effective diameter of said leg and defining an elongated opening between each of said handles and the tabletop to facilitate grasping each said handle; and means, attachable to said leg, for folding said leg from the extended position in which said leg supports the tabletop to the folded position in which said leg is folded within said envelope, said folding means being fully contained within said envelope when said leg is in its folded position.

2. The folding table leg apparatus of claim 1, further comprising:

means for mounting each of said handles to the tabletop, wherein each of said handles attaches between said plate assembly and the tabletop.

3. The folding table leg apparatus of claim 1, further comprising:

means, attached to said plate assembly, for releasably clamping said leg to said plate assembly when said leg is in its folded position.

4. The folding table leg apparatus of claim 3, wherein said means for releasably clamping is a resiliently flexible C-shaped member attached to said plate assembly and having an inner diameter substantially equal to the diameter of said leg, said C-shaped member resiliently flexing to receive said leg therein.

5. The folding table leg apparatus of claim 1, further comprising:

a non-marring surface situated along each of said handles and adapted to have another tabletop stacked thereon when said leg is in its folded position.

6. The folding table leg apparatus of claim 1, wherein said folding means further comprises:

means for releasably locking said leg in place when said leg is in its extended position, said locking means including a pair of independent biased lever arms straddling said leg and pivotably mounted to said plate assembly for releasing said locking means;

each of said lever arms being disposed adjacent a corresponding one of said pair of handles, whereby said handles are graspable when releasing said locking means to facilitate manipulation of said lever arms.

7. The folding table leg apparatus of claim 6, further comprising:

means for mounting each of said handles to the tabletop, wherein each of said handles attaches between said plate assembly and the tabletop.

8. The folding table leg apparatus of claim 7, further comprising:

means, attached to said plate assembly, for releasably clamping said leg to said plate assembly when said leg is in its folded position.

9. The folding table leg apparatus of claim 8, wherein said means for releasably clamping is a resiliently flexible C-shaped member attached to said plate assembly and having an inner diameter substantially equal to the diameter of said leg, said C-shaped member resiliently flexing to receive said leg therein.

10. The folding table leg apparatus of claim 9, further comprising:

a non-marring surface situated along each of said handles and adapted to have another tabletop stacked thereon when said leg is in its folded position.

11. A folding article of furniture, comprising:

a tabletop having a center of gravity and operable between an open and a folded position;

a single pedestal leg supporting said tabletop, said pedestal leg having a top portion and a vertical center of gravity below said top portion when said pedestal leg is in an upright position;

a folding apparatus engaged between said tabletop and said top portion of said pedestal leg, said folding apparatus including means for pivotably connecting said tabletop to said pedestal leg so that said center of gravity of said tabletop is movable towards said vertical center of gravity of said pedestal leg and below said top portion of said pedestal leg when said tabletop is in its folded position and said pedestal leg is in its upright position; and a handle attached to said folding apparatus between said centers of gravity.

12. The folding table leg apparatus of claim 11, further comprising:

means, attached to said plate assembly, for releasably clamping said pedestal leg to said plate assembly when said pedestal leg is in its folded position.

13. The folding table leg apparatus of claim 12, wherein said means for releasably clamping is a resiliently flexible C-shaped member attached to said plate assembly and having an inner diameter substantially equal to the diameter of said pedestal leg, said C-shaped member resiliently flexing to receive said pedestal leg therein.

14. The folding table leg apparatus of claim 11, further comprising:

a non-marring surface situated along said handle and adapted to have another tabletop stacked thereon when said pedestal leg is in its folded position.

15. A folding table, comprising:

an elongated tabletop;

a plurality of vertical legs; and a pair of folding apparatus, each associated with one of said plurality of vertical legs, each of said apparatus including;

a plate assembly;

means for mounting said plate assembly to said tabletop;

a pair of handles projecting from said plate assembly and defining an envelope adjacent to said plate assembly, each of said handles having a height from said tabletop greater than the effective diameter of said associated leg and defining an elongated opening between each of said handles and said tabletop to facilitate grasping each said handle;

means, attachable to said leg, for folding said associated leg into a folded position within said envelope, said folding means being fully contained within said envelope when said associated leg is in its folded position;

wherein each of said pair of folding apparatus is mounted to said tabletop disposed apart along its length so that one of said pair of handles from each of said pair of folding apparatus can are graspable simultaneously to facilitate lengthwise carrying of said table when in its folded position.

16. The folding table leg apparatus of claim 15, further comprising:

means for mounting each of said handles to said tabletop, wherein each of said handles extends between said plate assembly and said tabletop.

17. The folding table leg apparatus of claim 16, further comprising:

means for releasably clamping each of said legs to said plate assembly when said legs are in their folded position;

said means for releasably clamping for each leg including a resiliently flexible C-shaped member attached to said plate assembly and having an inner diameter substantially equal to the diameter of each leg, said C-shaped member resiliently flexing to receive each leg therein.

* * * * *